US006070960A

United States Patent [19]

Nakajima

[11] Patent Number: 6,070,960

[45] Date of Patent: Jun. 6, 2000

[54] INK JET RECORDING APPARATUS AND ITS CONTROL METHOD

[75] Inventor: Nobuyuki Nakajima, Yokohama, Japan

[73] Assignee: Canon Kabushiki Kaisha, Tokyo, Japan

[21] Appl. No.: 08/876,591

[22] Filed: Jun. 16, 1997

Related U.S. Application Data

[63] Continuation of application No. 08/578,446, Dec. 26, 1995, abandoned, which is a continuation of application No. 08/088,362, Jul. 9, 1993, abandoned.

[30] Foreign Application Priority Data

Jul. 16, 1992 [JP] Japan ..... 4-189497

[51] Int. Cl.[7] ..... B41J 2/165

[52] U.S. Cl. ..... 347/29; 347/23

[58] Field of Search ..... 347/19, 23, 29, 347/32, 33

[56] References Cited

FOREIGN PATENT DOCUMENTS 0443247 8/1991 European Pat. Off. .

0467648 1/1992 European Pat. Off. .

59-224355 12/1984 Japan .

1285353 11/1989 Japan .

3169560 7/1991 Japan .

*Primary Examiner*—N. Le

*Assistant Examiner*—Shih-Wen Hsieh

*Attorney, Agent, or Firm*—Fitzpatrick, Cella, Harper & Scinto

[57] ABSTRACT

According to the invention, whether a print head of, for example, the thermal jet system has been capped or not is informed to the user, thereby preventing that the user turns off the power source when the head is not capped. Even when the user turns off the power source in spite of the fact that the head is not capped yet, the capping status is checked before the power source is turned off. After the head was capped, the power source is turned off. Due to this, it is prevented that the print head is left while the head is not capped yet. The choking of the nozzles can be prevented.

24 Claims, 11 Drawing Sheets

PRINT OK

POWER OFF OK

FIG. 15

| P0 | P1 | SWITCH 141 | MAIN P/S | STATUS |
|---|---|---|---|---|
| 0 | 0 | OFF | OFF | DOWN |
| 0 | 1 | ON | ON | RUNNING |
| 1 | 0 | OFF | ON | INSTRUCT "POWER OFF" |
| 1 | 1 | OFF | ON | WAIT "POWER OFF" |

FIG. 16

| COMMAND BYTE | PARAMETER | TERMINATOR |
|---|---|---|
| 16a | 16b | 16c |

INK JET RECORDING APPARATUS AND ITS CONTROL METHOD

This application is a continuation of application Ser. No. 08/578,446 filed Dec. 26, 1995, abandoned which is a continuation of application Ser. No. 08/088,362 filed Jul. 9, 1993, abandoned.

BACKGROUND OF THE INVENTION

1. Field of the Invention

The present invention relates to, particularly, an ink jet recording apparatus which can print an image by emitting a liquid-like ink from a print head and to a control method of such an apparatus and, further, relates to a recording apparatus which can operate by turning on a power source and to a control method of such an apparatus.

2. Related Background Art

Hitherto, there has been a recording apparatus of the ink jet system which can print an image by emitting a liquid-like ink from a print head.

The conventional recording apparatus can operate by turning on a power source and cannot operate when the power source is turned off.

The invention will now be described with respect to a thermal jet system among the ink jet systems as an example.

The thermal jet system will be first explained.

According to the thermal jet system, in case of performing a multicolor printing, four kinds of inks of, for example, Y (yellow), M (magenta), C (cyan) and K (black) are emitted from a print head having a plurality of nozzles to a print paper, a color is reproduced by a color reduction mixture, and the inks are fixed onto a print paper by a natural dry, thereby printing an image.

The print head according to the thermal jet system moves in the direction (right and left directions) perpendicular to the transporting direction of the print paper as shown in FIG. 17.

A method of ejecting the ink will now be described with respect to one of a plurality of nozzles constructing the print head as an example as shown in FIG. 18. The liquid ink is filled in each nozzle as shown in the diagram. A heater to heat the nozzle is provided for every nozzle. First, in step 181, the nozzle is instantaneously heated by the heater, thereby generating bubbles in the inside of the ink as shown in steps 182 to 184. The ink is emitted by a pressure of the bubbles as shown in step 185.

As described above, the print head is constructed by a set of fine nozzles and, as an ink filled in each nozzle, a quick-drying ink is used so that it can be easily fixed onto the paper by the natural dry. Therefore, it is necessary to pay an attention to a choking of nozzles. In a non-printing state, accordingly, the print head is held at a home position shown in FIG. 17 in a standby state and the head is capped in order to prevent that the nozzles are dried, thereby preventing a choking of the nozzle.

However, hitherto, the print head is not always capped due to the relation of the printing operation when the print head is located at the home position. For example, a time interval of a few seconds exists until the print head is capped after the head was returned to the home position after completion of the printing operation. In the case where such a state is seen from the operator, however, the print head has already been returned to the home position and it seems as if the printing process including the capping operation has already been completed. Therefore, there is a serious drawback such that the operator turns off the power source before the print head is capped, so that the capping operation is stopped and the nozzles are left without being capped and the nozzles in the print head are dried and choked and a desired print result cannot be obtained in the next printing operation.

On the other hand, even if the operator has a knowledge of a capping process which is executed to prevent the choking of the nozzles of the print head, operator cannot discriminate whether the print head has been capped or not so long as the print head is merely seen. The operator cannot know how long he must wait for the operation to turn off the power source after the print head was returned to the home position. In case of using a method whereby the operator waits for the operation to turn off the power source until he can presume that the capping operation will have been finished, it is very inconvenient when he wants to turn off the power source as soon as possible.

SUMMARY OF THE INVENTION

According to the invention as described above, information indicating whether the print head of the recording apparatus is being capped or not or whether the apparatus is in a state in which it is permitted to turn off the power source is provided to the user. Therefore, the user can easily know the timing to turn off the power source of the recording apparatus. It is possible to prevent that the nozzles of the print head are dried because the power source is turned off at a wrong timing.

According to the invention as described above, when the switch is turned off by the user in order to turn off the power source of the recording apparatus, the capping state is checked and the power source is turned off after the head was capped. Therefore, even when the user turns off the power switch without knowing the capping state, the capping process can be certainly executed. It is possible to prevent that the nozzles of the print head are dried.

BRIEF DESCRIPTION OF THE DRAWINGS

FIG. 15 is a diagram showing the relations between the values of ports of the power controller and the status of an output apparatus;

FIG. 16 is a diagram showing an example of input command train in the embodiment 3;

DESCRIPTION OF THE PREFERRED EMBODIMENTS (Embodiment 1)

Figure 1:
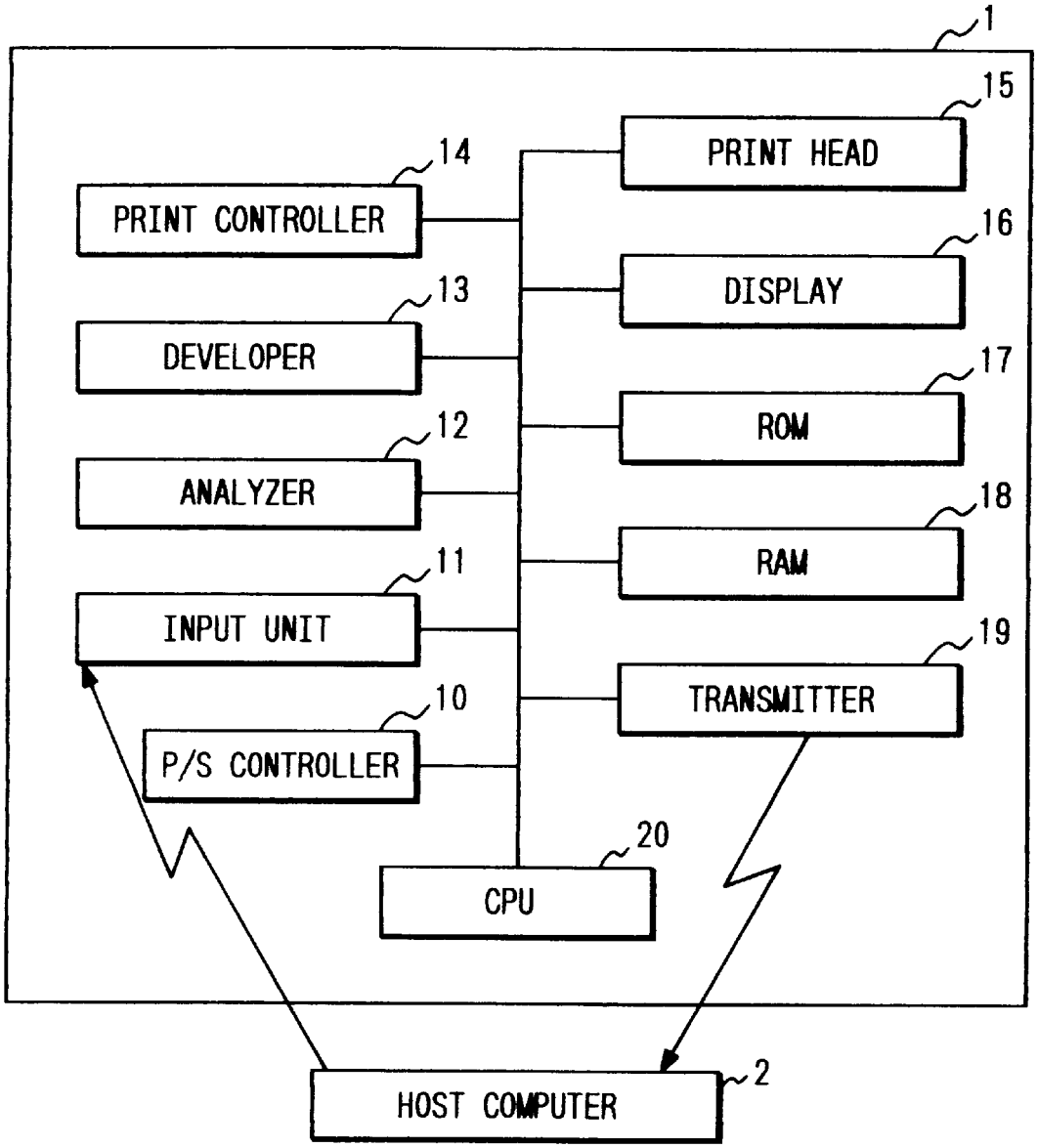
FIG. 1 is a diagram showing a construction of a recording apparatus according to the present invention.

FIG. 1 is a block diagram showing an example of a construction of an ink jet recording apparatus according to an embodiment. In FIG. 1, reference numeral 1 denotes a recording apparatus; 2 an external apparatus such as host computer, terminal device, or the like; and 10 a power source (P/S) controller to control an electric power supply which is necessary to the recording apparatus 1. A control about a user switch which is used by the user is also executed by the P/S controller 10. Reference numeral 11 denotes an input unit to receive data that is transferred from the host computer 2. It is now assumed that the host computer 2 is connected with the output apparatus 1 by a bidirectional communication protocol such as RS232C or the like. Reference numeral 12 denotes an analyzer to analyze the input data; 13 a developer to form bit map data of one page in accordance with the input data in the case where the input data is data regarding the printing operation or print control; and 14 a print controller to execute various kinds of processes to print the bit map data. The above various kinds of processes include: for instance, a process to convert the bit map data into a form suitable for a print head 15 to print, which will be explained hereinlater; a process to feed a print paper; a process to transmit the print data to the print head 15; a process to transport the print paper; a process to deliver the print paper to the outside of the recording apparatus; a process to detect the position in the right/left direction (phase from the home position) of the print head 15; and a process to detect an error status such as paper jam or the like. Reference numeral 15 denotes the print head for sequentially emitting the inks of four colors of Y, M, C, and K from a plurality of nozzles by the foregoing system in accordance with the print data transmitted by the print controller 14, thereby printing a print image onto the print paper. Reference numeral 16 denotes a display for informing an internal status of the recording apparatus 1 to the external apparatus. The internal status denotes, for example, a printable status, an error status due to the paper jam, a status of no ink, and a capping status of the print head. Reference numeral 17 denotes an ROM in which control programs according to flowcharts, which will be explained hereinlater, font data to be outputted, and the like are stored; 18 an RAM to store various kinds of data; 19 a transmitter to transmit the internal status of the recording apparatus 1 to the host computer 2. In the embodiment, the "internal status" which is transmitted to the host computer 2 denotes a capping status of the print head. Reference numeral 20 denotes a CPU to control the recording apparatus in according with the programs stored in the ROM 17.

Processes for displaying the capping status by the display in the recording apparatus will now be described with reference to flowcharts shown in FIGS. 2 to 4.

Figure 2:
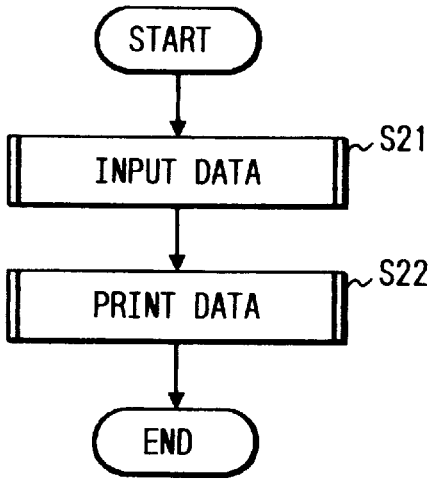
FIG. 2 is a flowchart showing processes for outputting print data of the one page according to an embodiment 1.
Figure 6:
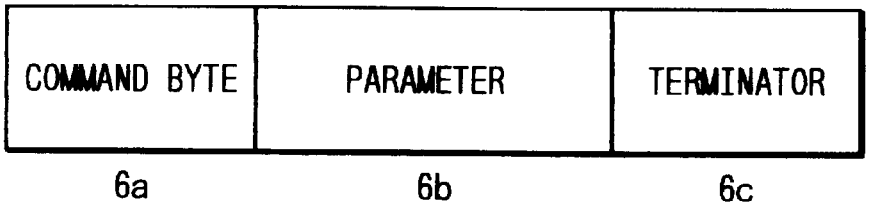
FIG. 6 is a diagram showing an example of input commands in the embodiment 1.

First, FIG. 2 shows the flowchart for main processes when print data of one page is generated. In step 21, the transmission data is inputted from the host computer 2 by the input unit 11. The input data in this instance relates to character data and commands to execute various print controls to form a print page. The command has a format as shown in FIG. 6 and comprises three portions of a command byte 6*a*, a parameter 6*b*, and a terminator 6*c*. Ordinarily, the kind of command is indicated by the command byte 6*a*, detailed contents regarding the command are designated by the parameter 6*b*, and the end of the command is shown by the terminator 6*c*. As a kind of command, for example, there are a designation of the printing position, a designation of the color, a size of character, a designation of an interval between lines, a change to a new page, and the like. In step 21, the data inputted to the input unit 11 is analyzed by the analyzer 12, color processes are executed, and bit map data of one page is formed in the developer 13.

In this instance, four kinds of bit map data are formed in accordance with the four colors of Y, M, C, and K. After the print data was formed, the printing operation is executed in step 22 in accordance with the following procedure. That is, the bit map data formed in step 21 is converted into a form suitable for the print head to print by the CPU 20. "Suitable form" which is used in this specification depends on the shape of print head. For example, when the print head is constructed by 64 nozzles in the vertical direction, the bit map data is divided into blocks each comprising 64 rasters from the top. After the data was converted, the CPU 20 generates a command to the print controller 14 so as to feed the print paper. A system regarding the paper feed command can be controlled by a signal line or can be realized by generating a command or the like which has been predetermined by a software. After the print controller 14 received the paper feed command and executed the paper feeding operation, the CPU 20 transmits the data blocks to the print controller. That is, the CPU 20 transfers the bit map data of 64 rasters of each of four colors of Y, M, C, and K. The print controller 14 receives a print command from the CPU 20 and transmits the data blocks to the print head 15 and drives the print head 15, thereby printing onto the print paper by the foregoing system. Namely, the bit map of 64 dots in the vertical direction is printed in response to one print command while moving the print head 15 from the left to the right (one scan). The CPU 20 subsequently generates the paper feed command to the print controller 14, thereby feeding the paper by an amount corresponding to the height of head (64 dots in this case). After the above series of operations (namely, transfer of the data blocks, print command, paper feed command) were repeated by the number corresponding to one page, the CPU 20 generates a paper delivery command to the print controller 14 and finishes the printing operation of one page. After completion of the printing operation, the print head 15 is moved to the home position at the left edge by the print controller 14 and is capped.

Figure 3:
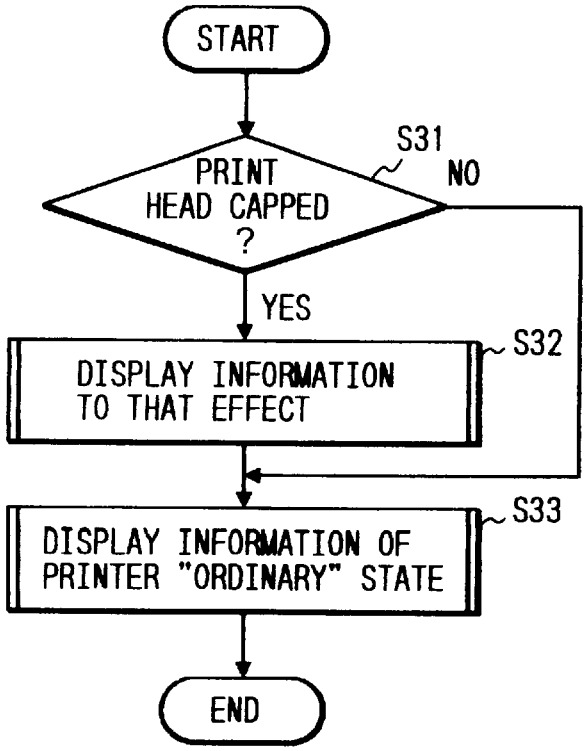
FIG. 3 is a flowchart showing status displaying processes of a printer in the embodiment 1.
Figure 5A:
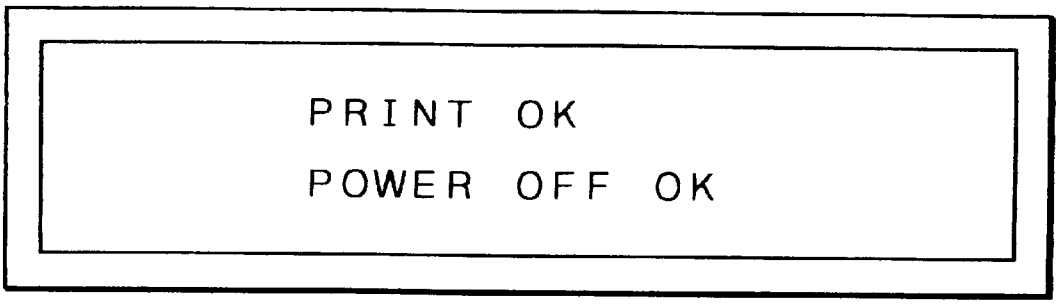
FIGS. 5A, 5B and 5C show display examples of display means in a recording apparatus.
Figure 5B:
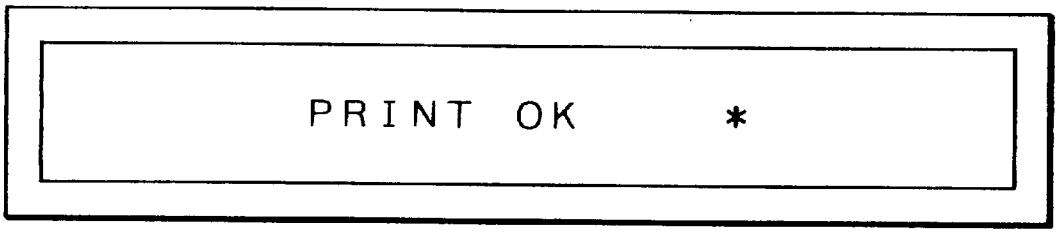
Figure 5C:
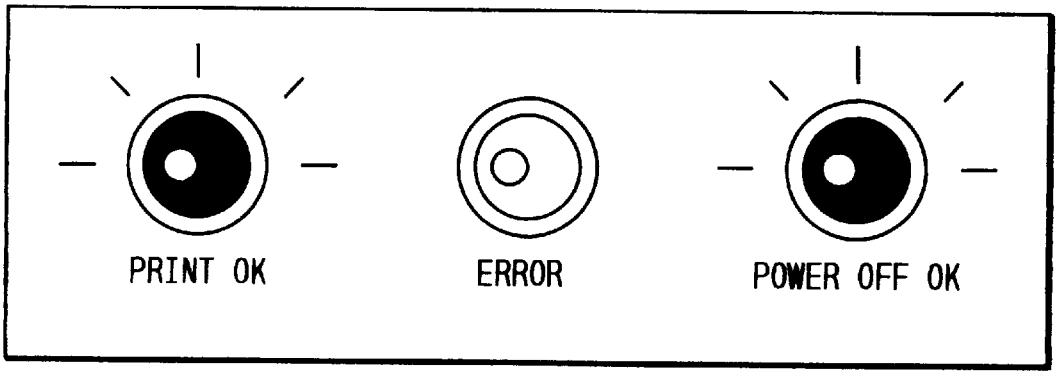

FIG. 3 is a flowchart regarding the display to inform the internal status or the like to the external apparatus. Those processes are executed a synchronously with the processes to output the print data of one page shown in FIG. 2. In step 31, the CPU 20 inquires to the print controller 14 to check whether the print head 15 is located at the home position or not. A method regarding such an inquiry can be controlled by the signal line as mentioned above or can be also realized by generating a command status or the like which has been predetermined by a software. The print controller 14 recognizes the present position of the print head as a phase from the home position and responds to the CPU in accordance with the value of such a phase. When the print head is not capped, in step 33, the CPU 20 allows the display 16 to execute an ordinary printer status display. "Ordinary printer status" which is used here denotes a status of the printer other than the capping status of the print head and is, for example, a printable status, an error status due to the paper jam, or a status of no ink. Those internal statuses of the printer are obtained by periodically monitoring whether each of the control apparatuses normally operates or not by the CPU 20. As a display 16, a liquid crystal display (LCD) as shown in FIGS. 5A and 5B can be used, light emitting diodes (LED) as shown in FIG. 5C can be also used, or lamps corresponding to the LED can be also used. The above ordinary printer status is displayed by, for example, "PRINT OK" in FIGS. 5A and 5B or is indicated by lighting on the "PRINT OK" LED and lighting off the "ERROR" LED in FIG. 5C.

In step 31, when the print head is capped, the CPU 20 allows the display 16 to display a message indicative of such a state in step 32. Namely, a message "POWER OFF OK" is displayed in FIG. 5A, "*" is displayed in FIG. 5B, and the "POWER OFF OK" LED is lit on in FIG. 5C.

Figure 4:
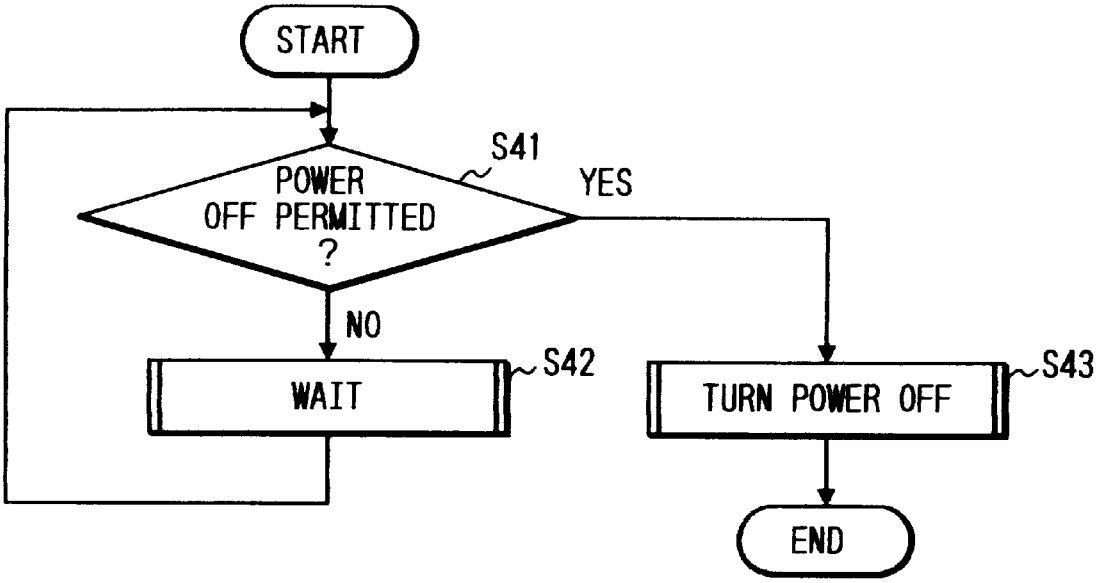
FIG. 4 is a flowchart for processes when the user turns off a power source of the printer according to the embodiment 1.

FIG. 4 is a flowchart showing a procedure when the user turns off the power source of the output apparatus. In step 41, the user checks to see if it is permitted to turn off the power source of the printer or not by observing the content displayed on the display 16 of the form shown in FIGS. 5A to 5C. When the power source of the printer is permitted, it is turned off in step 43. When the print head is not capped yet and it is not permitted to turn off the power source, the user waits for a little while in step 42.

(Embodiment 2)

With reference to flowcharts of FIGS. 7 to 9, explanation will now be made with respect to the second embodiment in which in the recording apparatus having the construction shown in the block diagram of FIG. 1, capping information is requested to the recording apparatus 1 from the host computer 2 and the capping information is sent to the host computer in response to such a request and the capping status is informed to the user from the host computer.

Figure 7:
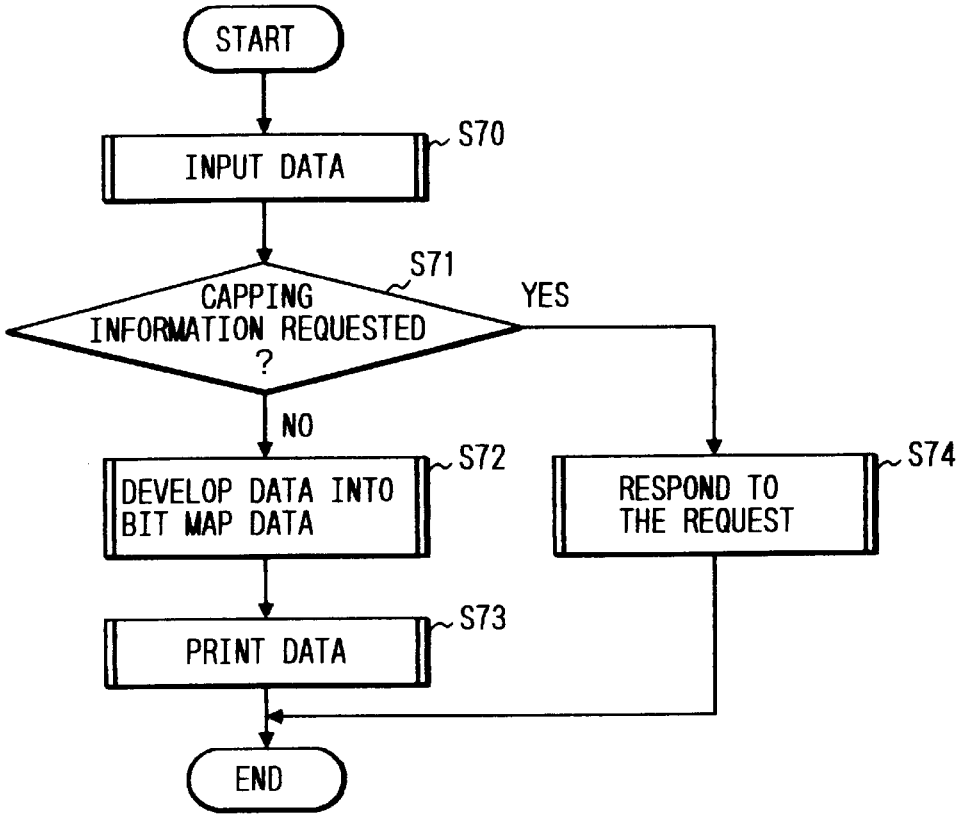
FIG. 7 is a flowchart for processes to generate print data of one page and to respond according to an embodiment 2.
Figure 8:
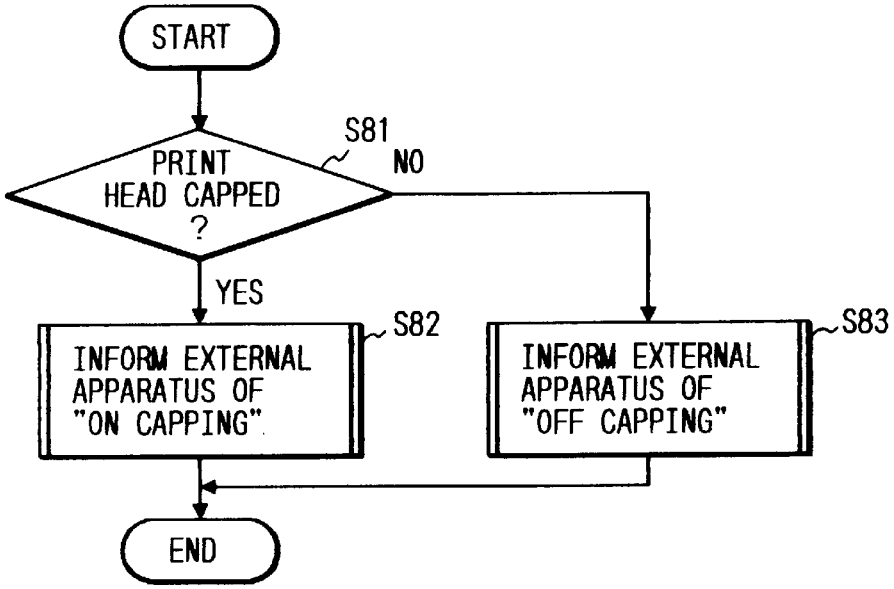
FIG. 8 is a flowchart for transmitting processes of capping information in the embodiment 2.
Figure 11:
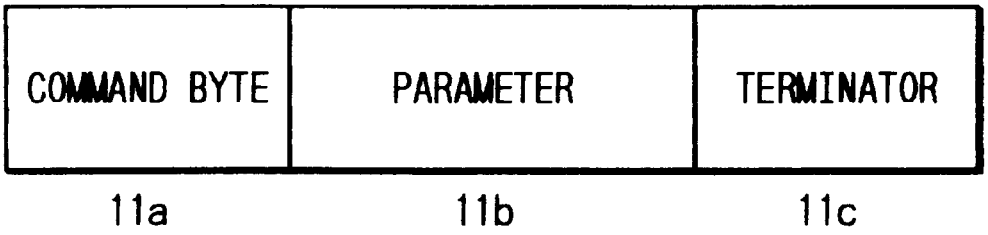
FIG. 11 is a diagram showing an example of input commands in the embodiment 2.

FIG. 7 is the flowchart when the output apparatus inputs print data and generates the print data of one page or responds. First, in step 70, the transmission data from the host computer is inputted by the input unit 11. The input data in this instance relates to character data and commands to perform various print controls to form a print page. The command has a format as shown in FIG. 11 and is constructed by three portions of a command byte 11*a*, a parameter 11*b*, and a terminator 11*c*. Ordinarily, the kind of command is shown by the command byte 11*a*, the detailed contents regarding the command are designated by the parameter 11*b*, and the end of the command is indicated by the terminator 11*c*. As kinds of such commands, for example, there are a designation of the printing position, a designation of the color, a size of character, a designation of an interval between lines, a change to a new page, a capping information request, and the like. In step 71, the input data is analyzed, thereby discriminating whether the input data is a capping information request command or not. This discrimination is performed by the command byte 11*a* in FIG. 11 as mentioned above. When the input data is not the capping information request command, it is determined that the input data is print data or print control data, so that the processing routine advances to step 72. In step 72, the command is further analyzed in detail by the analyzer 12. Color processes are executed in accordance with the command. Bit map data for printing is formed. In this instance, four kinds of bit map data are formed in correspondence to four colors of Y, M, C, and K. After the print data was formed, the printing operation is executed in step 73 in accordance with the following procedure. Namely, the bit map data formed in step 72 is converted into a format suitable for the print head to print by the print controller 14. "Suitable format" which is used here depends on the shape of print head. For instance, when the print head is constructed by 64 nozzles in the vertical direction, the bit map data is divided into every 64 rasters from the top. After the data was converted, the print controller 14 feeds the print paper and transmits the data blocks to the print head 15 and drives the print head 15, thereby printing onto the print paper in accordance with the foregoing system. That is, the print head 15 prints the bit map of 64 dots in the vertical direction by one printing operation (one scan) while moving once from the left to the right. After that, the print controller 14 transports the paper by an amount corresponding to the height of head (64 dots in this case). After the series of operations (namely, transfer of the data blocks, printing, paper feed) were repeated by the number of times corresponding to one page, the print controller 14 delivers the paper to the outside of the recording apparatus, thereby finishing the printing operation of one page. After completion of the printing operation, the print head 15 is moved to the home position at the left edge by the print controller 14 and is capped.

When the analyzed input data indicates the capping information request command in step 71, responding processes to the external apparatus are executed. FIG. 8 shows the flowchart showing the responding processes.

Figure 10:
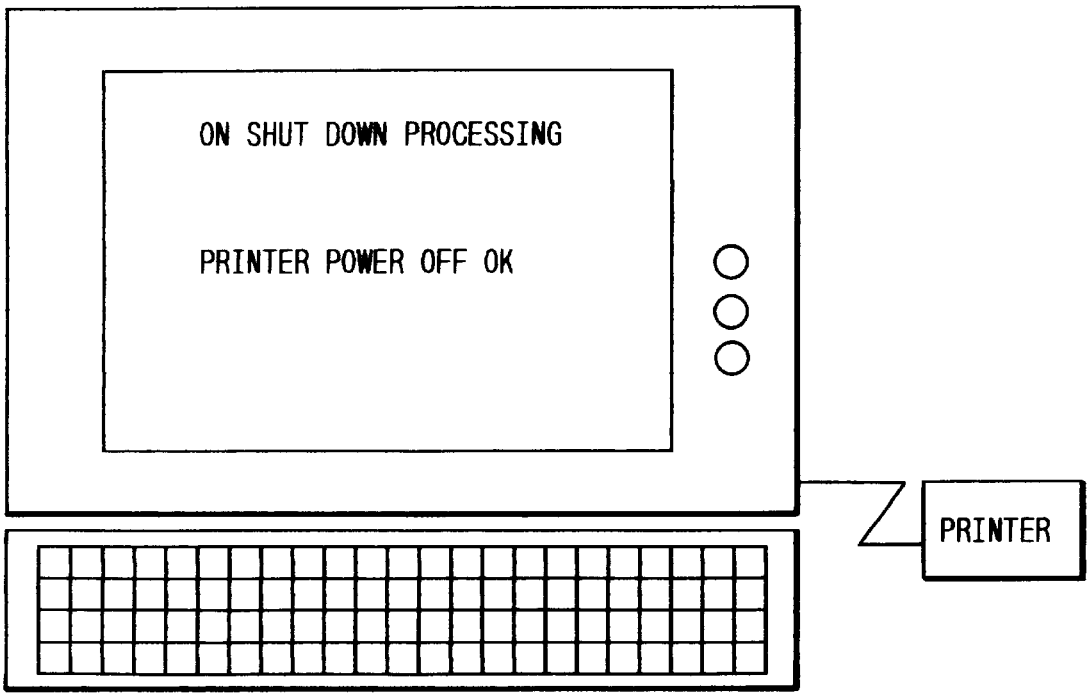
FIG. 10 is a diagram showing a display example by a host computer.

In step 81, the transmitter 19 inquires to the print controller 14 with respect to whether the print head 15 is located at the home position or not. A method regarding such an inquiry can be controlled by the signal line or can be also realized by generating a command status which has been predetermined by a software or the like. The print controller 14 recognizes the present position of the print head as a phase from the home position and responds to the transmitter 19 in accordance with the value of such a phase. In steps 82 and 83, information regarding whether the print head has been capped or not is transmitted from the transmitter 19 to the external apparatus. The transmission data in this instance has a format shown in FIG. 11. The command byte 11*a* indicates that the data indicates the capping information command. Whether the print head is being capped or not is shown by the parameter 11*b*. The end of the command is indicated by the terminator 11*c*. In the embodiment, only the capping information command has been described as a command. However, as another command indicative of the internal status of the output apparatus, for example, it is easily possible to expand to a command to notify the error status or the like and such a method is effective. The host computer receives the command and analyzes, thereby recognizing that the output apparatus is ON capping or not. Therefore, apparatuses corresponding to the input unit 11 and the analyzer 12 of the output apparatus are also necessary for the host computer. It is considered that the host computer generates a capping status request command to the output apparatus when the power source of the system including the host computer is OFF. In this case, however, when a message indicating that the print head is being capped is transmitted from the output apparatus by the capping information, the host computer allows a message as shown in FIG. 10 to be displayed on the display device such as a CRT or the like.

Figure 9:
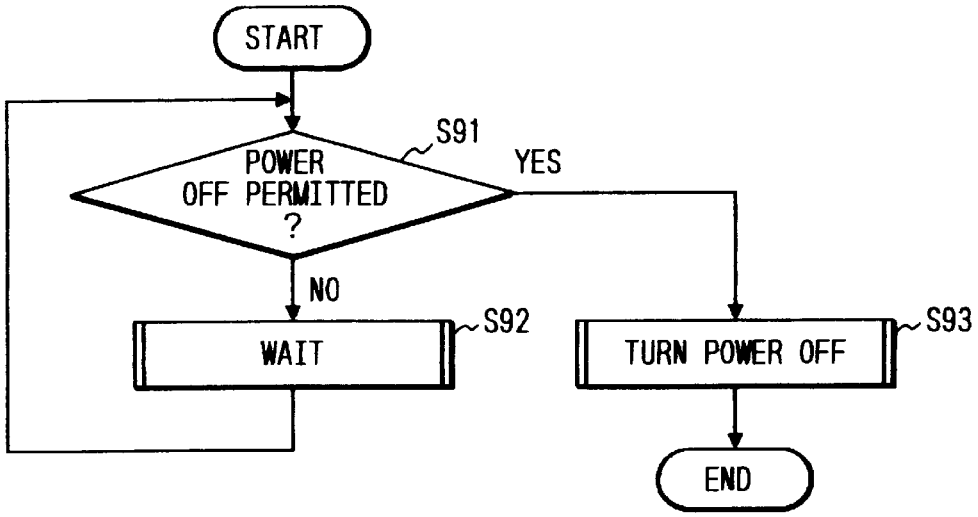
FIG. 9 is a flowchart for processes when the user turns off the power source of the printer in the embodiment 2.

FIG. 9 is a flowchart showing a procedure when the user turns off the power source of the output apparatus. In step 91, the user checks to see if it is permitted to turn off the power source of the printer or not by observing the content displayed on the CRT having the format shown in FIG. 10. When it is permitted to turn off the power source, it is turned off in step 93. When the head is not capped yet and it is not permitted to turn off the power source, the apparatus waits for a little while in step 92.

(Embodiment 3)

With reference to FIGS. 12 to 16, explanation will now be made with respect to an embodiment in which in the recording apparatus having the construction shown in the block diagram of FIG. 1, when the switch to turn off the power source is depressed, the power supply is controlled so as to be shut off after the capping status was confirmed.

Figure 12:
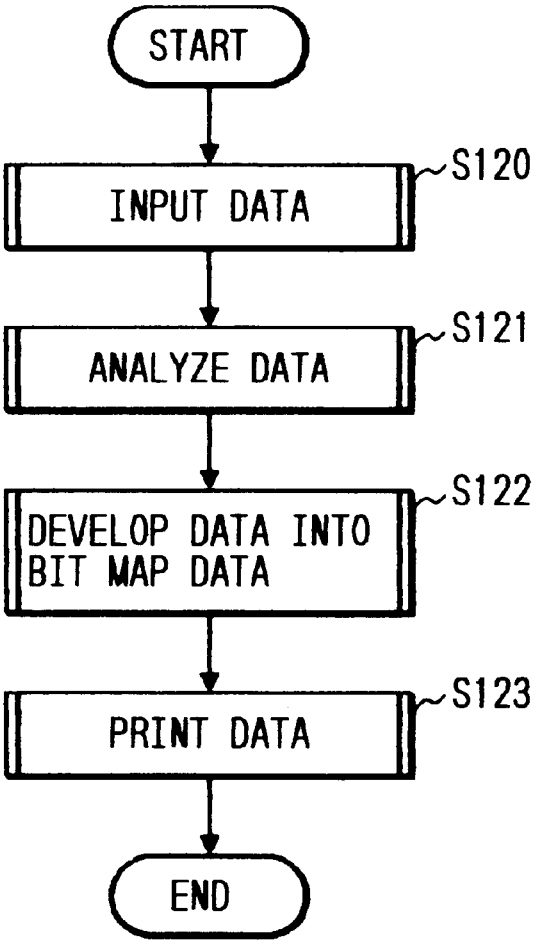
FIG. 12 is a flowchart showing processes to generate print data of one page according to an embodiment 3.

FIG. 12 is a flowchart when the output apparatus inputs data and generates the print data of one page. First, in step 120, the transmission data from the host computer is inputted by the input unit 11. The input data in this instance relates to character data and commands to execute various print controls to form a print page. The command has a format as shown in FIG. 16 and is constructed by three portions of a command byte 16*a*, a parameter 16*b*, and a terminator 16*c*. Ordinarily, the kind of command is shown by the command byte 16*a*, the detailed contents regarding the command are designated by the parameter 16*b*, and the end of the command is shown by the terminator 16*c*. As kinds of commands, for example, there are a designation of the printing position, a designation of the color, a size of character, a designation of an interval between lines, a change to a new page, and the like. In step 121, the input data is analyzed. In step 122, color processes are executed by the developer 13 in accordance with the command, thereby forming bit map data for printing. In this instance, four kinds of bit map data are produced in correspondence to four colors of Y, M, C, and K. After the print data was formed, the printing operation is executed in step 123 in accordance with the following procedure. Namely, the bit map data formed in step 122 is converted into a form suitable for the print head 15 to print by the print controller 14. "Suitable form" which is used here depends on the shape of print head. For example, when the print head is constructed by 64 nozzles in the vertical direction, the bit map data is divided into blocks of every 64 rasters from the top. After the data was converted, the print controller 14 feeds the print paper and transmits the data blocks to the print head 15 and drives the print head 15, thereby printing onto the print paper by the foregoing system. Namely, the print head 15 prints the bit map of an amount corresponding to 64 dots in the vertical direction by one printing operation (one scan) while rotating once from the left to the right. After that, the print controller 14 transports the paper by an amount corresponding to the height of the head (64 dots in this case). After the above series of operations (namely, transfer of data blocks, printing, paper feed) were repeated by the number of times corresponding to one page, the print controller 14 delivers the paper to the outside of the recording apparatus and finishes the printing operation of one page. After the printing operation was completed, the print head 15 is moved to the home position at the left edge by the print controller 14 and is capped.

Processes when the power source of the output apparatus is turned off will now be described with reference to FIGS. 13 and 14. FIG. 14 is a diagram showing a construction of the P/S controller 10. In the diagram, reference numeral 141 denotes a user switch which is used when the user turns off the power source of the output apparatus. The connecting state is set to ON and the non-connecting state is set to OFF. Reference numeral 142 denotes an interruption generator for generating an interruption to activate shut-down processes, which will be explained hereinlater, in the P/S controller 10 when the user switch 141 is turned off from the ON state. Reference numeral 143 denotes a power off instructor to instruct the turn-off of the power source to a main power source (P/S) unit 144, which will be explained hereinlater. Reference numeral 144 denotes the main P/S unit for supplying or shutting off the power supply of the output apparatus in accordance with statuses of ports $P_0$ and $P_1$.

Figure 13:
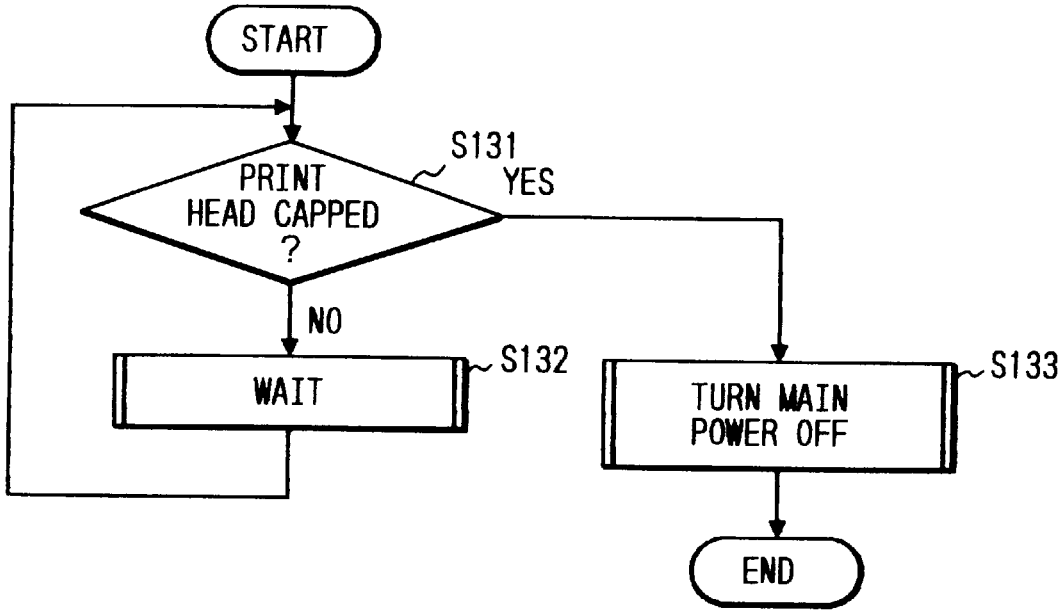
FIG. 13 is a flowchart for processes to shut off in a power source controller.
Figure 14:
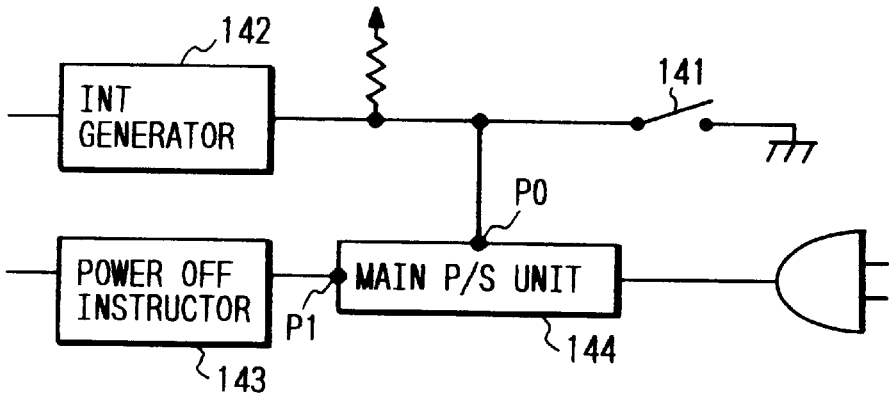
FIG. 14 is a diagram showing an example of a construction of the power controller.
Figure 17:
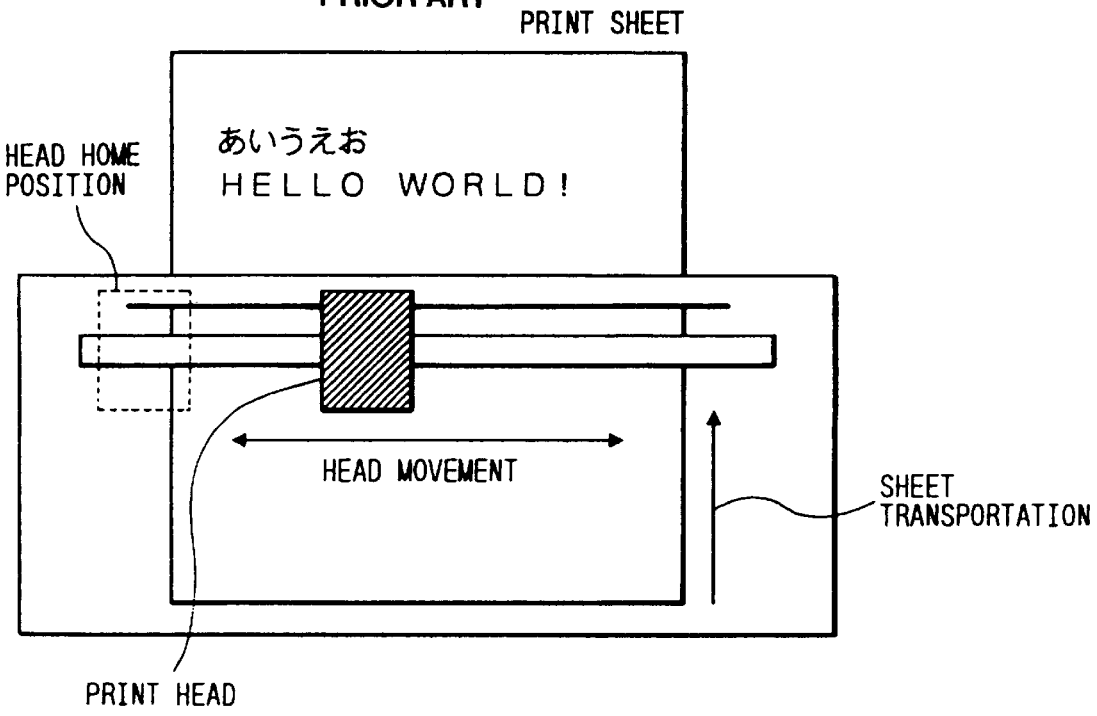
FIG. 17 PRIOR ART
FIG. 17 is a diagram showing the relation between the print head and the position of the printer.
Figure 18:
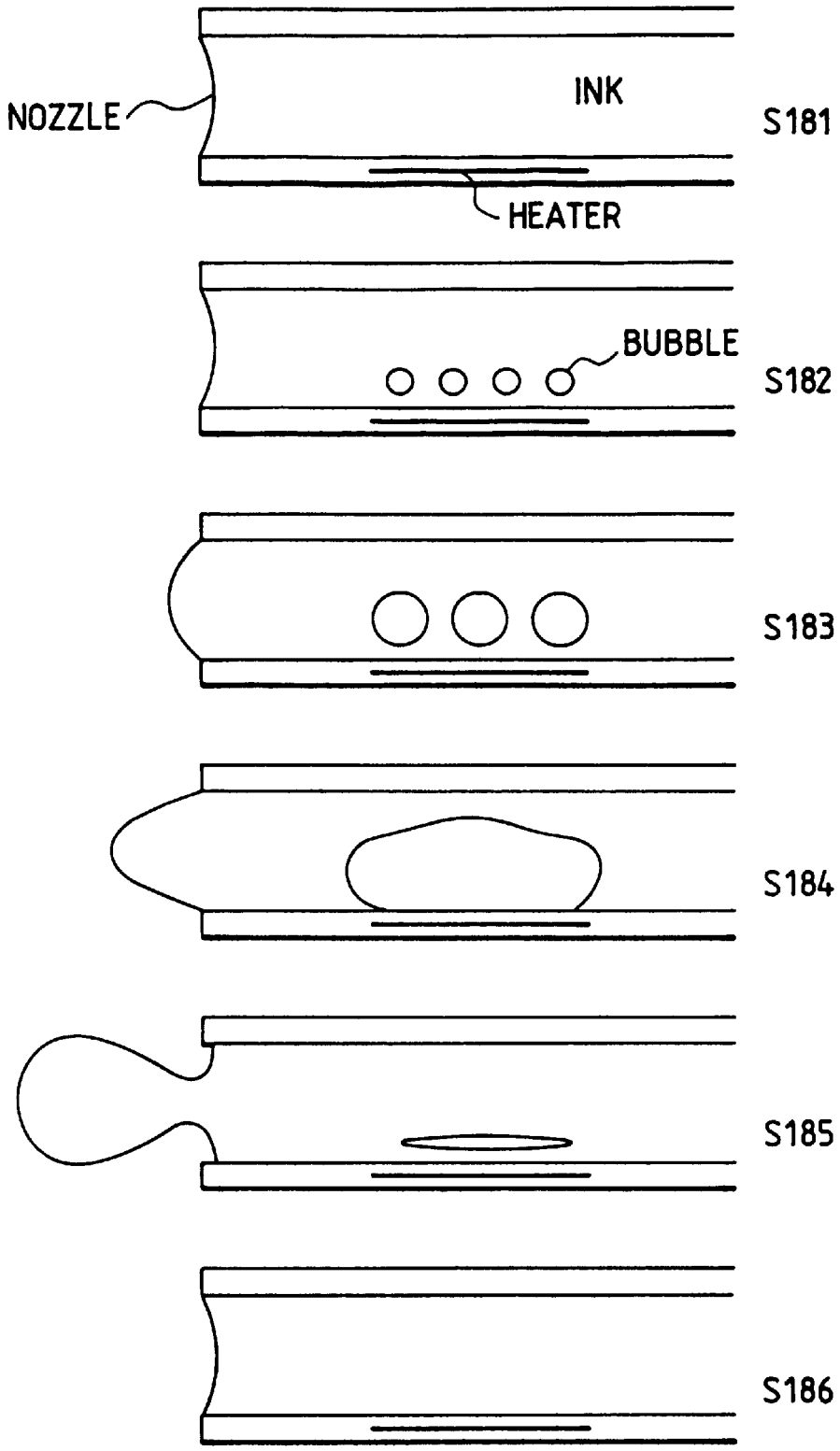
FIG. 18 PRIOR ART
FIG. 18 is a diagram for explaining a thermal jet system.

FIG. 13 is a flowchart for shut-down processes which are executed by the P/S controller 10. The shut-down processes are executed due to an interruption which is generated from the interruption generator 142 when the user turns off the user switch 141 as mentioned above. In step 131, the P/S controller 10 inquires whether the print head 15 is located at the home position or not to the print controller 14. A method regarding such an inquiry can be controlled by the signal line or can be also realized by generating a command status which has been predetermined by a software or the like. The print controller 14 recognizes the present position of the print head as a phase from the home position and responds to the P/S controller 10 in accordance with the value of such a phase. When it is determined that the head is not capped in step 131, the apparatus waits in step 132. After that, the processing routine is again returned to step 131. When it is decided that the head has been capped, the main power source is turned off in step 133. The processes in this instance are executed by the instructor 143 and the main P/S unit 144 through the ports $P_0$ and $P_1$. The above processes will now be described with reference to FIG. 16. It is now assumed that a value which can be set for each port is a binary number for convenience of explanation. Ordinarily, the current supplying state is set to 1 and the current non-supplying state is set to 0. The ports $P_0$ and $P_1$ of the main P/S unit 144 are respectively set to 0 and 0 in a state in which the power source is OFF. Such a state is expressed by $(P_0, P_1)=(0, 0)$. In this instance, the user switch 141 is OFF and the main power source is OFF. When the user switch 141 is turned on in the state of $(P_0, P_1)=(0, 0)$, the state is changed to $(P_0, P_1)=(0, 1)$. Namely, the port $P_0$ is connected to the ground and the port $P_1$ is set into a current supplying state by the main P/S unit 144. When the user switch 141 is turned off by the user in such a state, $(P_0, P_1)=(1, 1)$ and the interruption is generated as mentioned above and the shut-down processes are executed. After that, the main power source is turned off in step 133. By setting the port $P_1$ to 0 by the power off instructor 143, a command to turn off the power source is instructed to the main P/S unit 144. In this instance, $(P_0, P_1)=(1, 0)$. The main P/S unit 144 receives such a state, namely, $(P_0, P_1)=(1, 0)$ and turns off the main power source. Thus, the states of the ports are set to $(P_0, P_1)=(0, 0)$.

The electric power supply of the output apparatus is shut off via the procedure as mentioned above.

What is claimed is:

1. An ink jet recording apparatus for printing by emitting an ink, comprising:

control means for controlling a supply of an electric power used in said ink jet recording apparatus;

shut-off instruction input means for inputting an instruction for instructing shut-off of the electric power supply;

monitoring means for monitoring a status of a capping operation;

output control means for controlling output of information indicating release of an inhibit condition of said shut-off instruction input means after said monitoring means detects that the capping operation has been completed; and detecting means for detecting that the instruction for instructing shut-off of the electric power supply is input by said shut-off instruction input means after release of the inhibit condition, wherein the control by said control means is executed in response to a detection by said detecting means.

2. An apparatus according to claim 1, wherein said monitoring means monitors the status of the capping operation periodically.

3. An apparatus according to claim 1, wherein said shut-off instruction input means inputs the instruction for the shut-off in response to actuation of a switch.

4. An apparatus according to claim 1, wherein said monitoring means sends the status of the capping operation to a host computer.

5. An apparatus according to claim 1, further comprising a print head for which the capping operation is executed.

6. An apparatus according to claim 1, further comprising a host computer.

7. An apparatus according to claim 1, wherein the instruction input by said shut-off instruction input means comprises an instruction for turning off the electric power supply in said apparatus.

8. An apparatus according to claim 1, wherein said inhibition means executes an inhibiting operation through a host computer connected to said apparatus.

9. An ink jet recording method for printing by emitting an ink, comprising the steps of:

controlling a supply of an electric power used in said ink jet recording;

inputting an instruction for shut-off of the electric power supply;

monitoring a status of a capping operation;

outputting information indicating release of an inhibit condition of the step of inputting the instruction for shut-off of the electric power supply after a detection in said monitoring step that the capping operation has been completed; and detecting, after release of the inhibit condition, that the instruction for the shut-off of the electric power supply has been inputted, wherein said controlling is performed in response to a detection in said detecting step.

10. A method according to claim 9, wherein said monitoring step is performed periodically.

11. A method according to claim 9, wherein the instruction for shut-off is input in response to actuation of a switch.

12. A method according to claim 9, wherein said monitoring step further comprises sending the status of the capping operation to a host computer.

13. A method according to claim 9, further comprising the step of providing a print head for which the capping operation is executed.

14. A method according to claim 9, further comprising the step of providing a host computer.

15. A method according to claim 9, wherein the instruction for shut-off comprises an instruction for turning off the electric power supply.

16. A method according to claim 9, wherein said inhibiting step is executed through a host computer.

17. A computer readable medium in which is stored computer readable code to be executed by a computer, said computer readable code performing a method for controlling an ink jet recording operation, the method comprising the steps of:

controlling a supply of an electric power used in said ink jet recording operation;

inputting an instruction for shut-off of the electric power supply;

monitoring a status of a capping operation;

outputting information indicating release of an inhibit condition of the step of the instruction for shut-off of the electric power supply after a detection in said monitoring step that the capping operation has been completed; and detecting, after release of the inhibit condition, that the instruction for the shut-off of the electric power supply has been inputted, wherein said controlling of the electric power supply is performed in response to a detection in said detecting step.

18. A computer readable medium according to claim 17, wherein said monitoring step is performed periodically.

19. A computer readable medium according to claim 17, wherein the instruction for shut-off is input in response to actuation of a switch.

20. A computer readable medium according to claim 17, wherein said monitoring step further comprises sending the status of the capping operation to a host computer.

21. A computer readable medium according to claim 17, wherein the ink jet recording operation is performed using a print head for which the capping operation is executed.

22. A computer readable medium according to claim 17, wherein the computer comprises a host computer.

23. A computer readable medium according to claim 17, wherein the instruction for shut-off comprises an instruction for turning off the electric power supply.

24. A computer readable medium according to claim 17, wherein said inhibiting step is executed through a host computer.

* * * * *

UNITED STATES PATENT AND TRADEMARK OFFICE

CERTIFICATE OF CORRECTION

PATENT NO. : 6,070,960
DATED : June 6, 2000
INVENTOR(S) : Nakajima

It is certified that error appears in the above-identified patent and that said Letters Patent is hereby corrected as shown below:

Title page,
Under "References Cited", there should be inserted

-- U.S. PATENT DOCUMENTS
5,608,432 3/1997 Yamaguchi --

FOREIGN PATENT DOCUMENTS
"1285353" should read -- 1-285353 --; and
"3169560" should read -- 3-169560 --.

Column 10,
Line 24, "step of" should read -- step of inputting --.

Signed and Sealed this

Sixteenth Day of April, 2002

*Attest:*

*Attesting Officer*

JAMES E. ROGAN
*Director of the United States Patent and Trademark Office*